US005203404A

United States Patent [19]

Chiang et al.

[11] Patent Number: 5,203,404

[45] Date of Patent: Apr. 20, 1993

[54] HEAT EXCHANGER TUBE

[75] Inventors: Robert H. L. Chiang, Liverpool; Daniel Gaffaney, Chittenango; Albert J. Kallfelz, Camillus, all of N.Y.

[73] Assignee: Carrier Corporation, Syracuse, N.Y.

[21] Appl. No.: 844,051

[22] Filed: Mar. 2, 1992

[51] Int. Cl.[5] ..... F28F 1/26

[52] U.S. Cl. ..... 165/133; 165/179; 165/184

[58] Field of Search ..... 165/133, 179, 184

[56] References Cited

U.S. PATENT DOCUMENTS

| | | | |
|---|---|---|---|
| 3,326,283 | 3/1965 | Ware | 165/181 |
| 4,040,479 | 8/1977 | Campbell et al. | 165/133 |
| 4,166,498 | 9/1979 | Fujie et al. | 165/133 |
| 4,195,688 | 4/1989 | Fujie et al. | 165/133 |
| 4,245,695 | 1/1981 | Fujikake | 165/133 |
| 4,313,248 | 2/1982 | Fujikake | 165/179 |
| 4,330,036 | 5/1982 | Satoh et al. | 165/184 |
| 4,348,794 | 9/1982 | Kim et al. | 165/184 |
| 4,549,606 | 10/1985 | Sato et al. | 165/179 |
| 4,715,436 | 12/1987 | Takahashi et al. | 165/133 |
| 4,921,042 | 5/1990 | Zohler | 165/179 |
| 5,054,548 | 10/1991 | Zohler | 165/184 |

FOREIGN PATENT DOCUMENTS

| | | | |
|---|---|---|---|
| 83189 | 5/1983 | Japan | 165/133 |
| 64194 | 4/1985 | Japan | 165/133 |
| 237295 | 10/1987 | Japan | 165/179 |

*Primary Examiner*—John Rivell
*Assistant Examiner*—L. R. Leo

[57] ABSTRACT

A heat exchanger tube (10) for use in an application, such as a shell and tube type air conditioning system condenser, in which a fluid flowing through the heat exchanger external to the tubes condenses by transfer of heat to a cooling fluid flowing through the tubes. The tube has at least one fin convolution (22) extending helically around its external surface (13). Multiple axial notches (23) are impressed into the fin at intervals along its extent. Because the notches are impressed and not cut into the fin, material displaced from a fin to form a notch forms lateral projections (24) from the the walls of the fin. The notched fins provide increased external heat transfer surface area on the tube, destabilize the film of condensate on the tube external surface, thus causing the film to be generally thinner, and promote condensate drainage from the fins and off the tube and thus increase the heat transfer performance of the tube.

3 Claims, 3 Drawing Sheets

HEAT EXCHANGER TUBE

BACKGROUND OF THE INVENTION

This invention relates generally to heat exchanger tubes of the type used in shell and tube type heat exchangers. More particularly, the invention relates to a tube for use in an application such as a condenser for an air conditioning system.

A shell and tube type heat exchanger has a plurality of tubes contained within a shell. The tubes are usually arranged to provide a multiplicity of parallel flow paths for one of two fluids between which it is desired to exchange heat. The tubes are immersed in a second fluid that flows through the heat exchanger shell. Heat passes from the one fluid to the other fluid by through the walls of the tube. In one typical application, in an air conditioning system condenser, a cooling fluid, usually water, flows through the tubes of the condenser. Refrigerant flows through the condenser shell, entering as a gas and leaving as a liquid. The heat transfer characteristics of the individual tubes largely determines the overall heat transfer capability of such a heat exchanger.

There are a number of generally known methods of improving the efficiency of heat transfer in a heat exchanger tube. One of these is to increase the heat transfer area of the tube. In a condensing application, heat transfer performance is improved by maximizing the amount of tube surface area that is in contact with the fluid.

One of the most common methods employed to increase the heat transfer area of a heat exchanger tube is by placing fins on the outer surface of the tube. Fins can be made separately and attached to the outer surface of the tube or the wall of the tube can be worked by some process to form fins on the outer tube surface.

Beside the increased heat transfer area, a finned tube offers improved condensing heat transfer performance over a tube having a smooth outer surface for another reason. The condensing refrigerant forms a continuous film of liquid refrigerant on the outer surface of a smooth tube. The presence of the film reduces the heat transfer rate across the tube wall. Resistance to heat transfer across the film increases with film thickness. The film thickness on the fins is generally lower than on the main portion of the tube surface due to surface tension effects, thus lowering the heat transfer resistance through the fins.

It is possible, however, to attain even greater improvement in condensing heat transfer performance from a heat transfer tube as compared to a tube having a simple fin enhancement.

SUMMARY OF THE INVENTION

The present invention is a heat transfer tube having fins formed on its external surface. The fins have notches extending generally perpendicularly across the fins at intervals about the circumference of the tube.

The notches in the fin further increase the outer surface area of the tube as compared to a conventional finned tube. In addition, the configuration of the finned surface between the notches promote drainage of refrigerant from the fin. In most applications, the tubes in a shell and tube type air conditioning condenser run horizontally or nearly so. With horizontal tubes, the notched fin configuration promotes drainage of condensing refrigerant from the fins into the grooves between fins on the upper portion of the tube surface and also promotes drainage of condensed refrigerant off the tube on the lower portion of the tube surface.

Manufacture of a notched fin tube can be easily and economically accomplished by adding an additional notching disk to the tool gang of a finning machine of the type that forms fins on the outer surface of a tube by rolling the tube wall between an internal mandrel and external finning disks.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
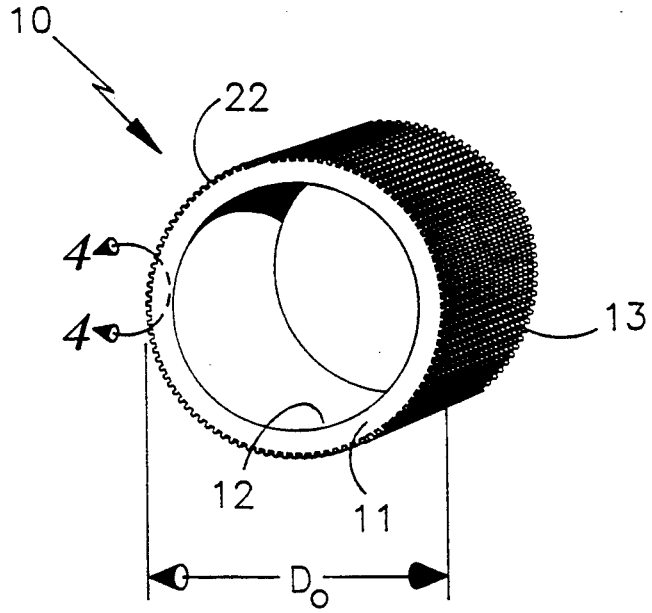
FIG. 1 is a pictorial view of the tube of the present invention.

FIG. 1 is a pictorial view of heat transfer tube 10 Tube 10 comprises tube wall 11, tube inner surface 12 and tube outer surface 13. Extending from the outer surface of tube wall 11 are external fins 22. Tube 10 has outer diameter $D_o$ as measured from tube outer surface 13 excluding the height of fins 22.

Figure 2:
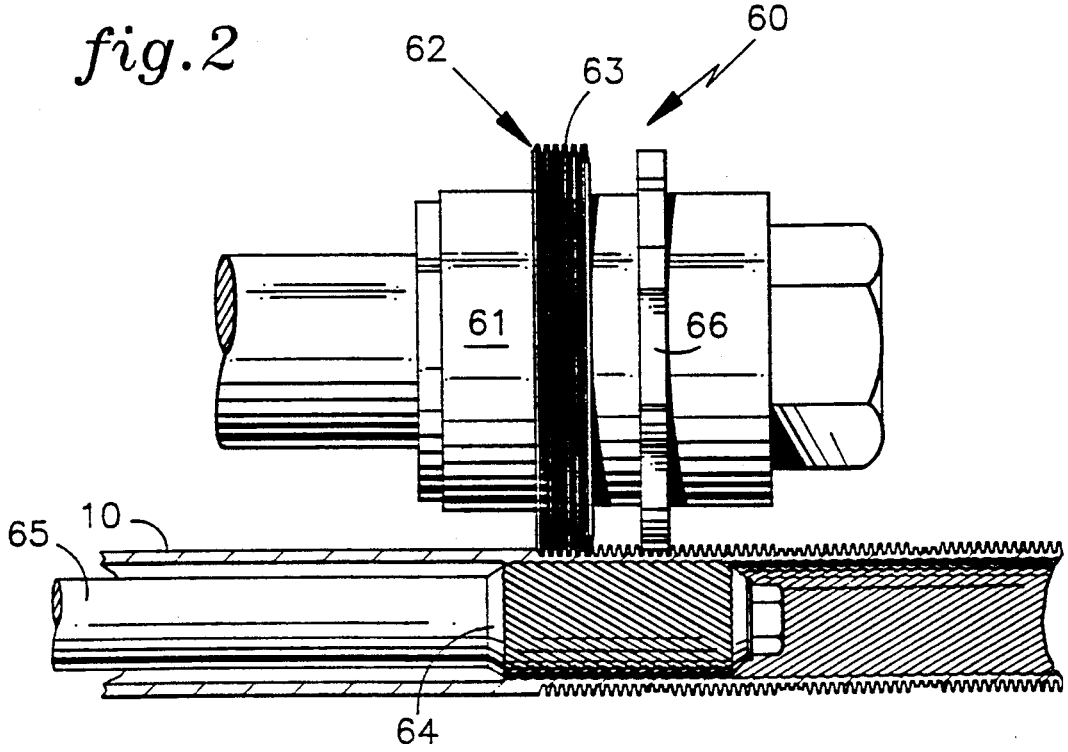
FIG. 2 is a view that illustrates how the tube of the present invention is manufactured.

The tube of the present invention may be readily manufactured by a rolling process. FIG. 2 illustrates such a process. In FIG. 2, finning machine 60 is operating on tube 10, made of a malleable metal such as copper, to produce both interior ribs and exterior fins on the tube. Finning machine 60 has one or more tool arbors 61, each containing a tool gang, comprised of a number of finning discs 63, and a notching wheel 66. Extending in to the tube is mandrel shaft 65 to which is attached mandrel 64.

Wall 11 is pressed between mandrel 65 and finning discs 63 as tube 10 rotates. Under pressure, metal flows into the grooves between the finning discs and forms a ridge or fin on the exterior surface of the tube. As it rotates, tube 10 advances between mandrel 64 and tool gang 62 (from left to right in FIG. 2) resulting in a number of helical fin convolutions being formed on the tube. In the same pass and just after tool gang 62 forms fins on tube lo, notching wheel 66 impresses axial notches in to the metal of the fins.

Parenthetically, note that mandrel 64 may be configured in such a way, as shown in FIG. 2, that it will impress some type of pattern in to the internal surface of the wall of the tube passing over it. A typical pattern is of one or more helical ribs. Such a pattern can improve the efficiency of the heat transfer between the fluid flowing through the tube and the tube wall.

Figure 3:
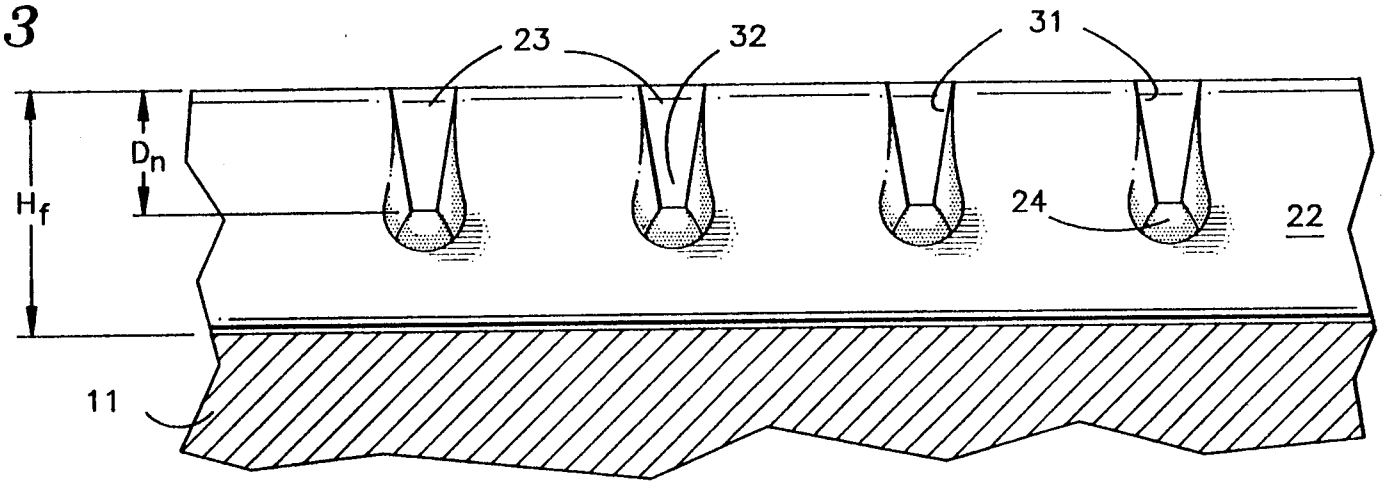
FIG. 3 is a partial sectioned, through line 3—3 in FIG. 5, view of a portion, detail IV in FIG. 1, of the tube of the present invention.

FIG. 3 is a view, in radial section, of a fin on the tube of the present invention. Fin 22 rises from tube wall 11 to fin height $H_f$. Notches 23 extend radially into and axially across the fin. Each notch 23 is roughly V shaped having steep, almost vertical opposite facing sides 31 and flat bottom 32 and extends downward to depth $D_n$ into fin 22.

Figure 4:
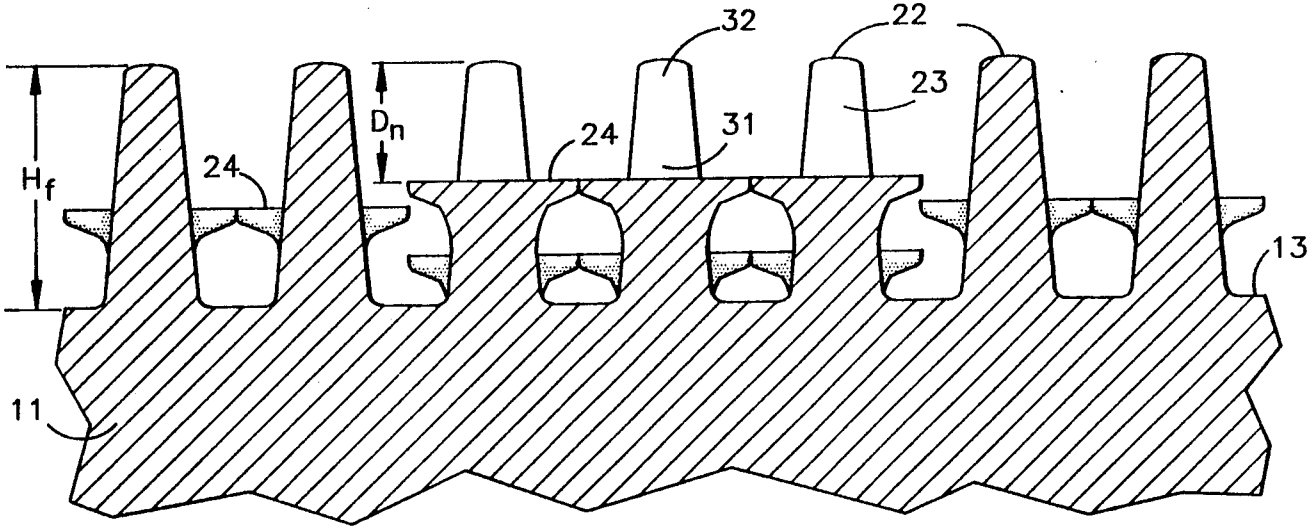
FIG. 4 is a partial sectioned, through line 4—4 in FIG. 5 view of a portion of the tube of the present invention.

FIG. 4 is a view, in axial section, of several adjacent fins. Each fin is roughly trapezoidal in cross section. Because, in the process described in conjunction with and illustrated by FIG. 2, notch 23 is impressed in to, rather than cut out of, fin 22, the metal displaced from the notch volume remains attached to the fin and forms lateral projections 24 that extend axially out from the sides of the fin. Lateral projections from adjacent ribs may, depending upon such factors as notch depth, meet midway between those ribs. The presence of the lateral projections further increases the surface area of the tube that is exposed to the fluid external to the tube and therefore increases the heat transfer performance of the tube.

Figure 5:
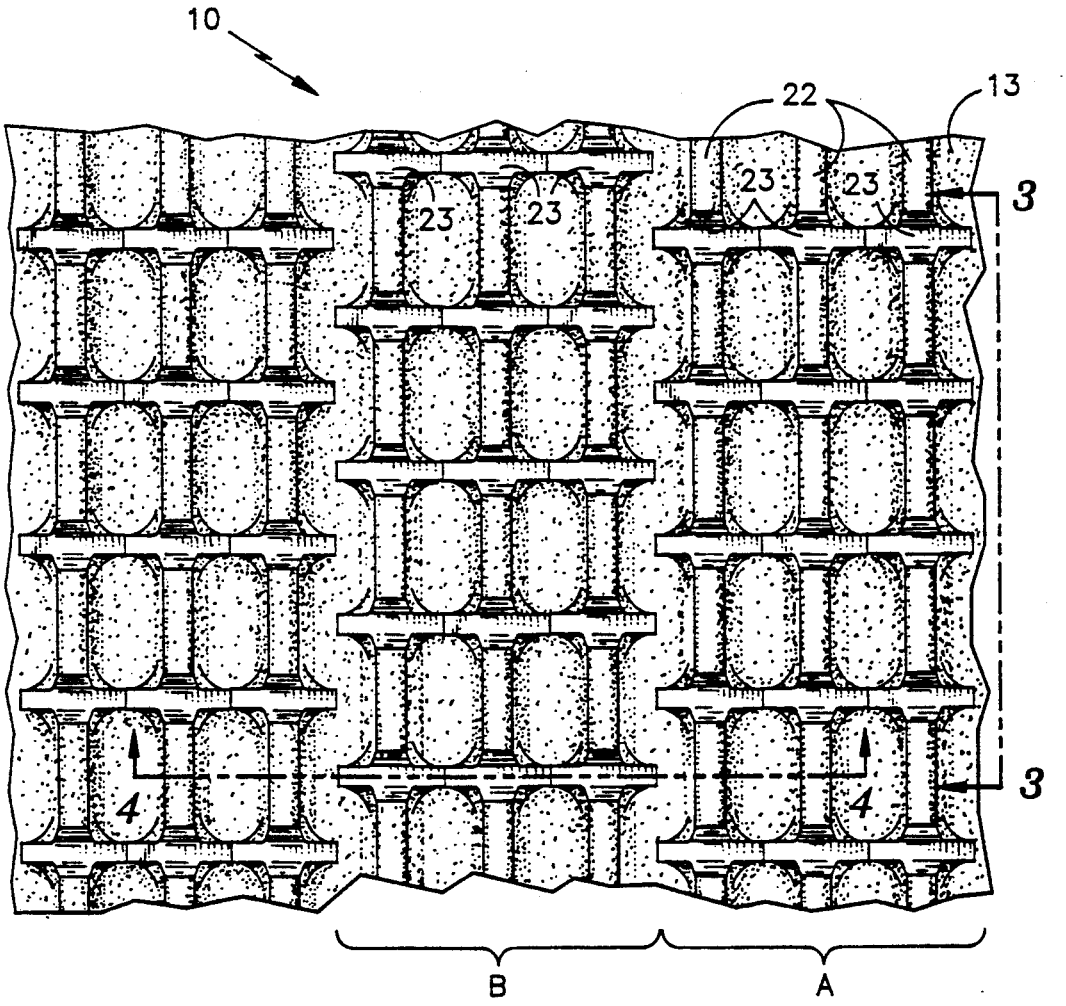
FIG. 5 is a partial view of a small portion of the external surface of the tube of the present invention.

FIG. 5 depicts a plan view of a portion of external surface 13 of tube 10. FIG. 5 shows notches 23 in the group of three adjacent fins 22 designated A to be in axial alignment, with the notches in adjacent fin group B also in axial alignment with each other but not in alignment with the notches in group A. This arrangement results because, during the manufacturing process that produced the tube shown in FIG. 5, the axial width of the teeth on notching wheel 66 (FIG. 2) was such that they spanned and impressed notches in three ribs at the same time. In addition, the notches in adjacent groups of three ribs are not in axial alignment because the circumference of notching wheel 66 was not evenly divisible by the circumference of tube 10. Neither the width of the notching wheel teeth nor the ratio of the circumferences is of particular significance to the heat transfer performance of the tube. The notches run axially and perpendicularly, or nearly so, to the ribs for ease and economy in making manufacturing tooling.

Performance tests of a notched fin tube operating in a refrigerant condensing environment have demonstrated that such a tube can have a heat transfer performance coefficient that is 40 percent improved over a conventional finned tube.

The performance tests were conducted on nominal 19 mm (¾ inch) outer diameter (O.D.) copper tubes having 17 fins per cm (43 fins per inch) of tube length. The ratio of fin heights to tube O.D. on the test tubes ranged from ranged from 0.035 to 0.053; there were 1.1 notches per cm (28 notches per inch) of tube outer circumference; and the notch depth was 0.4 times the fin height.

Extrapolations from test data indicated that comparable performance will be obtained in tubes having nominal 12.5 mm (½ inch) to 25 mm (1 inch) O.D. and 10 to 30 fins per cm (25 to 75 fins per inch) of tube length where:

a) the ratio of fin height to tube O.D. is between 0.025 and 0.075 or $$H_f=(0.025\text{–}0.075)D_o;$$

b) the number of notches per cm of tube outer circumference is 5 to 20 (14 to 50 notches per inch); and c) the notch depth is between 0.2 and 0.8 of the fin height or $$D_n=(0.2-0.8)H_f.$$

What is claimed is:

1. A heat exchanger tube (10) having an improved external surface configuration in which the improvement comprises:

at least one fin convolution (22), the ratio of the height of said fin convolution to the outer diameter of said tube being between 0.025 and 0.075, disposed helically about the external surface of said tube so that there are 20 to 30 fins per cm (5) to 75 fins per inch); and notches (23) extending radially into, to a depth of between 0.2 and 0.8 of said fin convolution height, and generally axially across said fin convolution at intervals about the circumference of said tube.

2. The tube of claim 1 in which the ratio of the height of said fin convolution to the outer diameter of said tube is between 0.035 and 0.053;

there are 11 notches per cm (28 notches per inch) of tube outer circumference; and the depth of said notches is 0.4 times said fin convolution height.

3. The tube of claim 1 further comprising projections (24), comprised of material displaced from said fin convolution in forming said notches, extending laterally from said fin convolution.

* * * * *

UNITED STATES PATENT AND TRADEMARK OFFICE

CERTIFICATE OF CORRECTION

PATENT NO. : 5,203,404

DATED : 20 APRIL 1993

INVENTOR(S) : ROBERT H.L. CHIANG ET AL.

It is certified that error appears in the above-identified patent and that said Letters Patent is hereby corrected as shown below:

Claim 1, lines 8 and 9 (column 4, lines 29-29): change "20 to 30 fins per cm (5) to 75 fins per inch)" to read -- 20 to 30 fins (51 to 75 fins per inch) --

Signed and Sealed this

Twenty-second Day of February, 1994

Bruce Lehman

*Attest:*

BRUCE LEHMAN

*Attesting Officer*

*Commissioner of Patents and Trademarks*